United States Patent [19]

Kägi

[11] Patent Number: 4,527,596

[45] Date of Patent: Jul. 9, 1985

[54] METHOD AND APPARATUS FOR CLEANING THE REED OF A WEAVING MACHINE

[75] Inventor: Bruno Kägi, Bubikon, Switzerland

[73] Assignee: Maschinenfabrik Sulzer-Rüti AG, Rüti, Switzerland

[21] Appl. No.: 614,835

[22] Filed: May 29, 1984

[30] Foreign Application Priority Data

Jun. 3, 1983 [EP] European Pat. Off. ..... 83810232.5

[51] Int. Cl.[3] ..... D03J 1/00

[52] U.S. Cl. ..... 139/1 C; 15/246; 15/312 R

[58] Field of Search ..... 139/1 C, 188; 15/246, 15/312 R, 312 A, 301

[56] References Cited

U.S. PATENT DOCUMENTS 1,517,961 12/1924 Cummings et al. ..... 15/312
2,634,560 4/1953 Ramm ..... 139/1 C
3,451,435 6/1969 Riha et al. ..... 139/1 C
3,785,408 1/1974 Strauss ..... 139/1 C

FOREIGN PATENT DOCUMENTS 383669 11/1923 Fed. Rep. of Germany .
2615483 4/1976 Fed. Rep. of Germany .

*Primary Examiner*—Henry S. Jaudon
*Attorney, Agent, or Firm*—Werner W. Kleeman

[57] ABSTRACT

Guide members with bifurcated forked ends are fastened to the cleaning apparatus, by means of which this cleaning apparatus can be mounted upon the reed. An endless belt is seated in the cleaning device and rotating cleaning brushes are contained in such cleaning apparatus. In this way, the cleaning apparatus can be slowly moved forward on the reed by means of at least one compressed air motor. By so doing, the reed wires or lamellae or the dents between them can be freed of dirt or other contaminants. The cleaning can take place without removing the reed from the weaving machine.

17 Claims, 6 Drawing Figures

METHOD AND APPARATUS FOR CLEANING THE REED OF A WEAVING MACHINE

BACKGROUND OF THE INVENTION

The present invention relates to a new and improved method for cleaning the reed of a weaving machine or loom, e.g. an air jet weaving machine, and to an improved apparatus for performing the aforesaid method.

Reeds of weaving machines have heretofore been cleaned by, for instance, severing the warp threads and withdrawing them from the reed, removing the reed from the weaving machine and cleaning it separately by hand or by means of a brushing machine. Subsequently, the warp threads must be again drawn into the reed and the latter inserted into the weaving machine. This way of cleaning is especially complicated and time-consuming.

It has heretofore been possible to clean the reed in the weaving machine itself only by means of hand brushes or compressed air. Such a cleaning procedure, in which the warp threads may remain in engagement with the reed, is somewhat less complicated but also not very effective. The operator must work carefully in order not to damage the reed wires or the warp threads engaging the reed. A second operator may even be required to remove the dirt or other contaminants by means of a vacuum cleaning device.

SUMMARY OF THE INVENTION

Therefore, with the foregoing in mind, it is a primary object of the present invention to provide a new and improved method and apparatus for cleaning the reed of a weaving machine which do not have associated therewith the aforementioned drawbacks and shortcomings of the prior art constructions.

A further significant object of the present invention aims at providing a new and improved apparatus of the character described which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the method of the present invention is manifested by the features that it comprises the steps of mounting a cleaning apparatus on a longitudinal member of the reed while the reed is located in the weaving machine, performing a translatory motion of the cleaning apparatus along the reed and operating the cleaning apparatus during the translatory motion for cleaning the reed.

The apparatus of the present invention is manifested by the features that it comprises a cleaning device, said cleaning device being provided with means for removeably installing the cleaning device on the reed of the weaving machine, and means for translating the cleaning device along the reed during cleaning of the reed.

By virtue of the aforementioned method the reed can be freed of dirt or other contaminants, e.g. fly lint, sizing agents and the like, easily and without having to be taken out of the machine. The apparatus is particularly suited for air jet weaving machines having sequential or intermittent jets distributed over the entire weaving width of the weaving machine or loom. The sequentially arranged air jets carry the weft thread into the loom shed and support it over the entire weaving width while maintaining the weft insertion line. In this type of weaving machine, a particularly severe contamination of the reed can arise, since dust from the weaving room environment is especially attracted by the air jets blowing into the reed. Furthermore, the air blown into the reed by the air jets is usually cleaned and dried compressed air which is particularly inclined to absorb moisture from the environment and with it, for instance, dust and fly lint from the weaving room. These contaminants are continually blown against the reed wires, which can particularly easily fill the dents.

BRIEF DESCRIPTION OF THE DRAWINGS

The invention will be better understood and objects other than those set forth above, will become apparent when consideration is given to the following detailed description thereof. Such description makes reference to the annexed drawings wherein through the various Figures of the drawings there have been generally used the same reference characters to denote the same or analogous components and wherein.

DETAILED DESCRIPTION OF THE PREFERRED EMBODIMENTS

Figure 1:
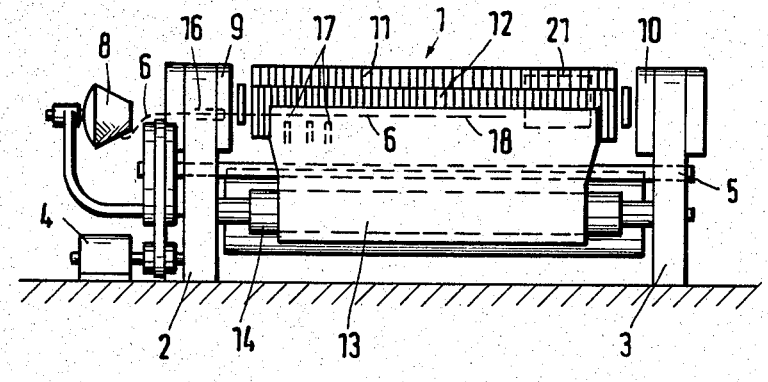
FIG. 1 shows a weaving machine employing the invention as seen from the fabric side.

Describing now the drawings, it is to be understood that to simplify the showing of the drawings only enough of the structure of the cleaning device or apparatus and related weaving machine or loom has been illustrated therein as is needed to enable one skilled in the art to readily understand the underlying principles and concepts of this invention. Turning now specifically to FIG. 1, the weaving machine or loom 1 will be seen to comprise side frame members or plates 2 and 3, a drive motor 4, a main shaft 5, a weft or filling thread supply roll 8 remaining outside of the loom shed, a picking or shot mechanism 9, a catch mechanism 10, harnesses 11, a reed 12 and a fabric roll or breast beam 14. The weft or filling thread 6 is carried into the loom shed by means of an air jet from a main nozzle 16 and the weft thread 6 is supported within the shed by sequential or relay nozzles 17. These sequential or relay nozzles 17 successively receive air as the tip 18 of the weft thread 6 advances, giving rise to a travelling air current. The fabric or cloth 13 being woven is wound up on the fabric roll or breast beam 14.

When the reed 12 is to be cleaned, the cleaning device or apparatus, designated in its entirety with the reference numeral 21 and represented in more detail in the FIGS. 2 through 5, can be set or mounted upon the reed 12 after halting the weaving machine 1, as is indicated in broken lines in FIG. 1.

A pneumatic drive motor 23 is mounted in a housing 22 of the cleaning device or apparatus 21 and is supplied from a suitable compressed air source through an air supply conduit or line 24. Conduit 24 contains a valve 27 acted upon by a spring 25 and this valve 27 can be thus subjected to a translatory motion in the direction of the double-headed arrow 26. The drive motor 23 drives, via a worm 28, a worm gear 29 upon the shaft 30 of which a gear 31 is mounted. The latter meshes with an essentially larger gear 32 upon the shaft 33 of which a first roll 34 is mounted over which an endless belt 35 is guided to a second roll 36.

Additionally, a further pneumatic drive motor 41 is mounted in the housing 22 and drives via a gear transmission 42, 43 two rotating brushes 45, 46 mounted on a shaft 44.

Figure 6:
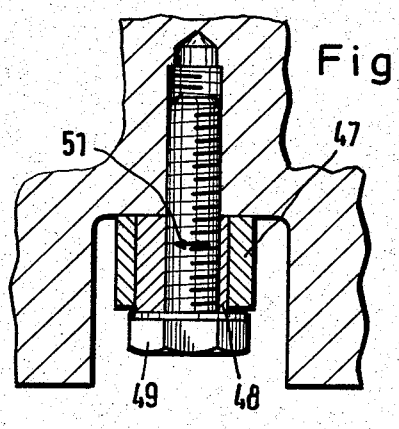
FIG. 6 shows a section through a detail of FIG. 2 on an enlarged scale.

Finally, the housing 22 contains for instance, a plastic roll or roller member 47 which is rotatably mounted on an eccentric 48 as shown in FIG. 6. The parts 47, 48 are fixable by means of a screw 49 or equivalent structure after the eccentric 48 has been approximately adjusted, which enables the roll 47 to be shifted transversely to the direction of its lengthwise axis, i.e. horizontally corresponding to double-headed arrow 51 in FIG. 6.

It will be seen in the FIGS. 2 through 5 that the cleaning apparatus 21 contains at its lower region a sheet metal strip 52 having two upwardly curved ends or extension members 53, 54.

Two guide members 56, 57 are mounted on the rear wall 55 of the housing 22. Their lower ends are constructed in a fork shape in the region 58. The guide members 56, 57 are eccentrically arranged, i.e. they are disposed remote from the central plane 63 defined by the two axes 61, 62 of the drive motors 23, 41.

When the reed 12 is to be cleaned, the weaving machine 1 must be halted. Then a wedge-shaped bar 64 of the sley 67 must be released by loosening the screws 65. Then the reed 12 held in the groove 66 of the sley 67 of the weaving machine must be slightly raised. Subsequently, two support members 71, 72 must be inserted with their respective feet 73 into the groove 66 at the ends 68, 69 on both sides of the reed 12. Then the neighboring screws 65 are tightened again. The reed 12 is now situated in the raised cleaning position **12*a* represented in the FIGS. 2 through 5. In this cleaning position the loosened warp threads 75, e.g. located in their closed shed position, are situated at the lowermost position 76 of the reed wires 78, which are provided with a guide groove 77, and consequently rest upon the lower reed frame member 79**.

Figure 3:
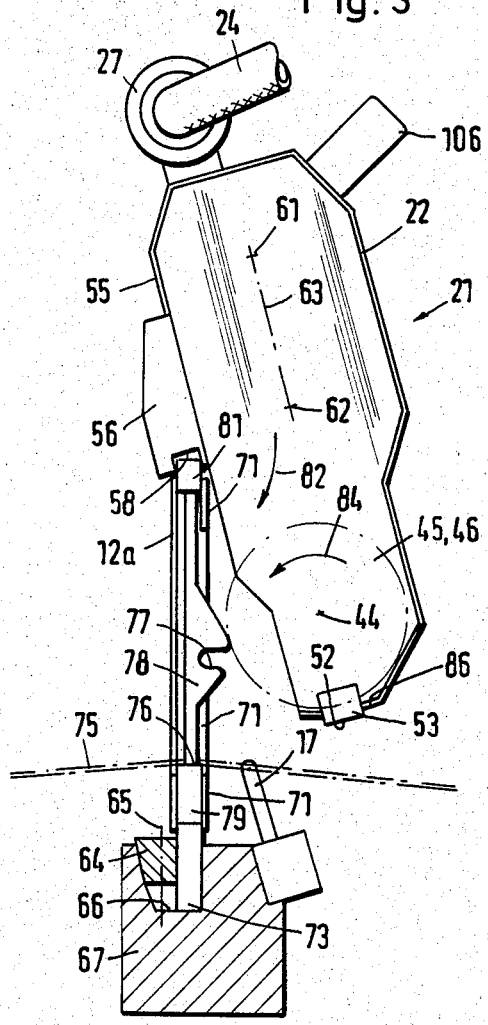
FIG. 3 shows an associated side view in partial section of the cleaning apparatus in a first position.
Figure 4:
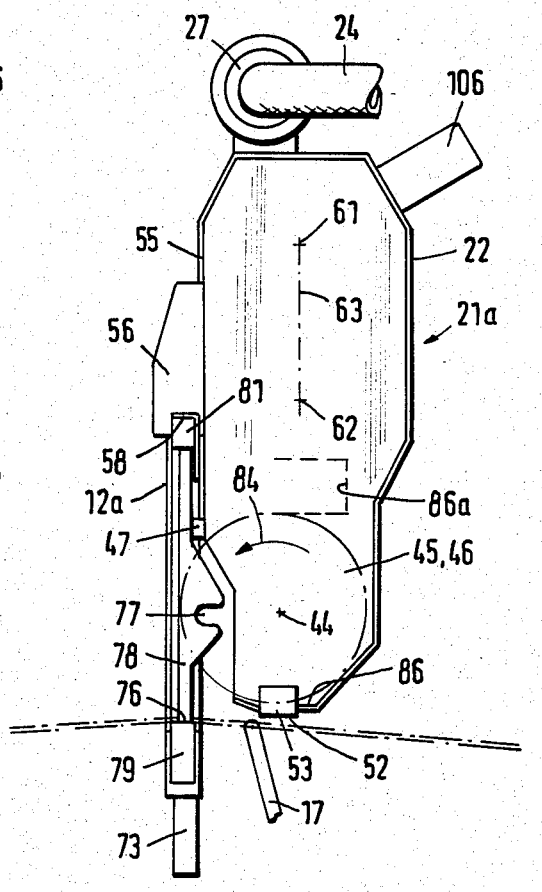
FIG. 4 shows a view corresponding to FIG. 3 of the cleaning apparatus in a second position.

Now the cleaning device or apparatus 21 is lifted over the upper reed frame member 81 in the tilted position of FIG. 3 together with the guide members 56, 57 and then lowered. The frame member 81 now forms a pivot point for the cleaning apparatus 21 about which this device or apparatus is pivoted under the action of gravity according to the arrow 82 in FIG. 3 into the operating position of FIG. 4 in which the central plane 63 containing the axes 61, 62 and the entire cleaning apparatus 21 are vertical. The support roll 47 bears against the reed wires or lamellae 78. The device or apparatus 21 is situated with its lower ends formed by the reed wires or lamellae 52 above the sequential or relay nozzles 17.

Figure 2:
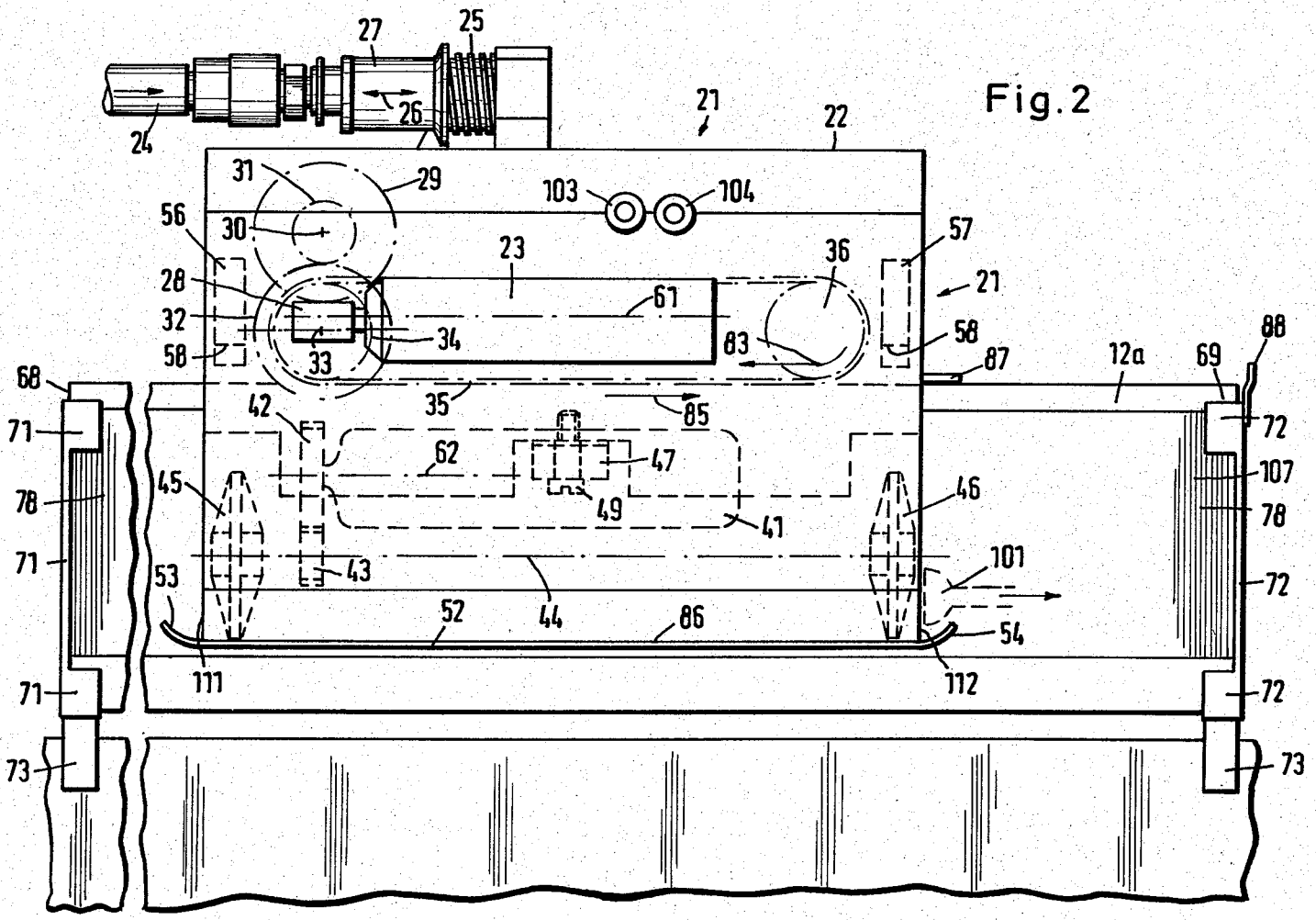
FIG. 2 shows a front view of the cleaning apparatus with the cover removed and on an enlarged scale.

Now the valve 27 is pressed against the action of the spring 25 in the direction of the arrow 26 in FIG. 2, such that both drive motors 23, 41 are supplied with compressed air. The endless belt drive 35 moves according to the arrow 83, and the cleaning brushes 45, 46 rotate according to the arrow 84. The cleaning apparatus 21 runs slowly to the right on the reed 12 in the direction of the arrow 85 in FIG. 2. The wires or lamellae 78 are cleaned by the brushes 45, 46 and the dirt or other contaminants can fall into a lower collection space 86.

Figure 5:
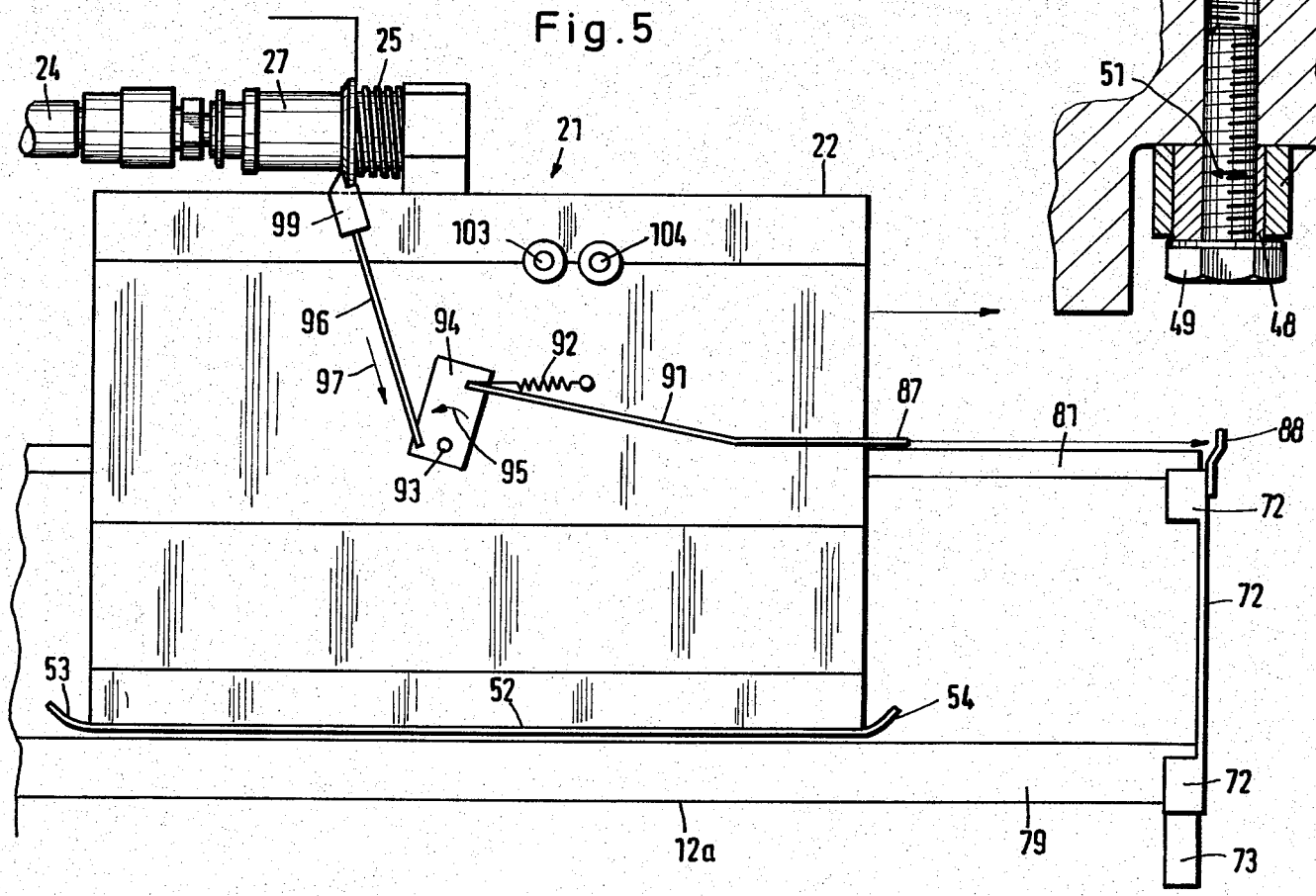
FIG. 5 shows a vertical section through the cleaning apparatus corresponding to FIG. 2 and in another vertical plane.

When a sensor 87 mounted on the cleaning apparatus 21 contacts a stationary stop member 88 fixed upon the support member 72, a control rod 91 is moved to the left as seen in FIG. 5 relative to the housing 22 against the action of a tension spring 92, which pivots a pivotable block 94 about a pin 93 in the direction of the arrow 95. This causes a further control rod 96 hingedly mounted upon the block 94 and a latch member 99 mounted upon the control rod 96 to move downwardly according to arrow 97, which releases the valve 27 and permits it to be moved toward the left as seen in FIG. 5 by the action of the spring 25. The conduit 24 is closed. The drive motors 23, 41 cease rotation and the cleaning operation is terminated.

If necessary, the dirt gathering in the collection space 86 can be removed by a suction nozzle 101 indicated in broken lines in FIG. 2.

The through-flow cross-section of the supply conduits leading to the two drive motors 23, 41 can be adjusted by two throttling valves 103, 104 shown in FIG. 2, so that the operational speed of these motors and thereby the speed of translatory motion of the cleaning apparatus 21 upon the reed 12 as well as the rotation of the cleaning brushes 45, 46 can be adjusted. The cleaning apparatus can be easily lifted off the reed 12 by means of a hand-grip 106 in order to lower the reed 12 back into the operational position after removing the support members 71, 72. The weaving operation can then be continued.

In a modified embodiment of the invention, electric motors are employed instead of the pneumatic motors 23, 41. It is also possible to effect the translatory motion of the cleaning apparatus 21 upon the reed 12 in the direction of the arrow 85 or the rotary motion of the brushes 45, 46, or both, by means of a manually-operated drive means, such as a crank drive. Instead of cleaning by means of the cleaning brushes 45, 46, if desired, compressed air can also be conducted through the dirty or contaminated spaces or dents 107 between the wires or lamellae 78.

The cleaning brushes 45, 46 can also rotate counter to the arrow 84 if an upper collection space **86*a* is provided. Cleaning can also be effected by spraying a cleaning fluid onto the rotating brushes 45, 46** (wet cleaning).

While there are shown and described present preferred embodiments of the invention, it is to be distinctly understood that the invention is not limited thereto, but may be otherwise variously embodied and practiced within the scope of the following claims.

Accordingly, what I claim is:

1. A method for cleaning the reed of a weaving machine such as an air jet weaving machine, comprising the steps of:

inserting a cleaning apparatus in the weaving machine;

said cleaning apparatus being adapted to the weaving machine; and moving the cleaning apparatus along the reed and cleaning the reed.

2. A method for cleaning the reed of a weaving machine, comprising the steps of:

mounting a cleaning apparatus on a longitudinal member operatively associated with the reed while the reed is located in the weaving machine;

performing a translatory motion of the cleaning apparatus along the reed; and operating the cleaning apparatus during said translatory motion for cleaning the reed.

3. An apparatus for cleaning the reed of a weaving machine, comprising:

a cleaning device;

said cleaning device being provided with means for removeably mounting said cleaning device on the reed of the weaving machine while the reed remains in the weaving machine; and means for translating the cleaning device along the reed during cleaning of such reed.

4. The apparatus as defined in claim 3, wherein:

said cleaning device is provided with at least one guide member engaging an upper frame member of the reed and defining said means for removeably mounting said cleaning device and for supporting said cleaning device upon the upper frame member of the reed.

5. The apparatus as defined in claim 4, wherein:

said at least one guide member supports the cleaning device on said upper frame member of the reed by the action of gravity.

6. The apparatus as defined in claim 4, wherein:

said cleaning device contains a housing;

said at least one guide member comprising two forked guide members eccentrically mounted on said housing;

pivot means for the cleaning device defined by said two forked guide members when mounted upon the reed; and the cleaning device pivoting about said pivot means into an operating position by the action of gravity when mounted upon the reed.

7. The apparatus as defined in claim 3, wherein:

said cleaning device contains a support roll;

the reed of the weaving machine having reed wires; and said support roll bearing and rolling upon the reed wires during the translatory motion of the cleaning device.

8. The apparatus as defined in claim 7, wherein:

said support roll has an axis of rotation; and means for adjusting the support roll in a direction extending across said axis of rotation.

9. The apparatus as defined in claim 3, wherein:

said means for translating the cleaning device along the reed during cleaning comprises a motor drive.

10. The apparatus as defined in claim 9, wherein:

said motor drive comprises a pneumatic motor drive.

11. The apparatus as defined in claim 9, wherein:

said motor drive includes an endless belt drive; and said endless belt drive engaging an upper frame member of the reed in frictional contact when mounted upon the reed.

12. The apparatus as defined in claim 11, wherein:

said endless belt drive is provided with a limit stop switch for terminating operation of the endless belt drive.

13. The apparatus as defined in claim 3, wherein:

said reed comprises reed wires; and the cleaning device containing rotary brushes penetrating between said reed wires.

14. The apparatus as defined in claim 13, further including:

motor drive means for driving said rotary brushes.

15. The apparatus as defined in claim 14, wherein:

said motor drive means comprises pneumatic motor drive means.

16. The apparatus as defined in claim 3, further including:

at least one support member for retaining the reed in an upper position during cleaning; and said at least one support member being insertable in a groove of a sley of the weaving machine after releasing the reed.

17. The apparatus as defined in claim 3, wherein:

the weaving machine comprises a weft shot mechanism and a weft catch mechanism;

the cleaning device having at least two ends;

said at least two ends being oriented toward respective ones of the weft shot mechanism and the weft catch mechanism; and the cleaning device being provided with upwardly curved extension members mounted at said at least two ends of the cleaning device for maintaining the warp threads therebeneath remote from the cleaning device during cleaning of the reed.

* * * * *